US011198054B1

(12) United States Patent
Holtey

(10) Patent No.: US 11,198,054 B1
(45) Date of Patent: Dec. 14, 2021

(54) UNIVERSAL CRIBBAGE BOARD FOR MULTI-VARIATION CRIBBAGE GAMES AND METHOD OF PLAY

(71) Applicant: Adam Webb Holtey, Talent, OR (US)

(72) Inventor: Adam Webb Holtey, Talent, OR (US)

( * ) Notice: Subject to any disclaimer, the term of this patent is extended or adjusted under 35 U.S.C. 154(b) by 0 days.

(21) Appl. No.: 16/878,135

(22) Filed: May 19, 2020

Related U.S. Application Data

(60) Provisional application No. 62/852,254, filed on May 23, 2019.

(51) Int. Cl.
*A63F 3/00* (2006.01)
*A63F 1/04* (2006.01)

(52) U.S. Cl.
CPC ..... *A63F 3/00261* (2013.01); *A63F 1/04* (2013.01); *A63F 3/00082* (2013.01); *A63F 3/00176* (2013.01); *A63F 2003/00182* (2013.01); *A63F 2003/00463* (2013.01)

(58) Field of Classification Search
CPC .... A63F 3/00261; A63F 1/04; A63F 3/00176; A63F 3/00082; A63F 2003/00463; A63F 2003/00182
USPC ..... D21/343, 393
See application file for complete search history.

(56) References Cited

U.S. PATENT DOCUMENTS 2,477,825 A 6/1947 Richardson
2,560,583 A 3/1949 Lupton
2,594,943 A 11/1949 Logan
3,695,512 A 10/1972 Trudel
4,598,912 A 7/1986 Kendrick et al.
5,407,206 A * 4/1995 Cohen ..... A63F 3/00006 235/90
5,590,883 A * 1/1997 Brewer ..... A63F 3/00006 273/249
D444,822 S * 7/2001 Miville ..... D21/343
6,257,577 B1 7/2001 Sutton
8,246,049 B1 * 8/2012 Martens ..... A63F 1/18 273/292
D778,368 S * 2/2017 Edevold ..... D21/343
2012/0282988 A1 11/2012 Martens et al.
2019/0076729 A1 3/2019 Olsen

* cited by examiner

*Primary Examiner* — Michael D Dennis
(74) *Attorney, Agent, or Firm* — Jerry Haynes Law

(57) ABSTRACT

A universal Cribbage board for playing multiple versions of a Cribbage game and method of play provides a universal Cribbage game board adapted to mark points accumulated during card play. The board game is configured for play with multiple versions of a traditional Cribbage card game. The game board has a continuous scoring track that is color-coded and extended to 130 peg holes to accommodate different versions of the traditional Cribbage game. A method of playing variations of the traditional Cribbage card game that are fundamentally the same as traditional Cribbage games, but differ in card scoring combinations, final scores, sequences of playing the cards, privileges, dealer advantages, strategic options, alternative point values, and different odds, in addition to the normal rules of the traditional Cribbage card game. The versions of the Cribbage game include a Holtey 500 Cribbage game, a Dealer's Cribbage game, and a Magic Cribbage game.

10 Claims, 5 Drawing Sheets

UNIVERSAL CRIBBAGE BOARD FOR MULTI-VARIATION CRIBBAGE GAMES AND METHOD OF PLAY

CROSS-REFERENCE TO RELATED APPLICATIONS

This application claims the benefits of U.S. provisional application No. 62/852,254, filed May 23, 2019 and entitled UNIVERSAL CRIBBAGE BOARD FOR MULTI-VARIATION CRIBBAGE GAMES AND METHOD OF PLAY, which provisional application is incorporated by reference herein in its entirety.

FIELD OF THE INVENTION

The present invention relates generally to a universal cribbage board for multi-variation cribbage games and method of play. More so, the present invention relates to a universal cribbage board that is configured for play with the Cribbage card game, defined by a scoring track that is continuous, color-coded, and extended to accommodate various versions of the traditional Cribbage card game; and further includes a method of playing variations of the traditional Cribbage card game that are fundamentally the same as the traditional Cribbage card game, but differ in the card scoring combinations, final scores, sequences of playing the cards, dealer advantages, strategic options, alternative point values, and different odds, in addition to the normal rules of the traditional Cribbage card game.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Generally, a Cribbage card game includes a card game that is played in conjunction with a Cribbage game board to mark points accumulated during card play. The Cribbage game board is used for scoring rather than usual pencil and paper. The game board is equipped with holes that accommodate playing pegs. Two or more people can play the game. Or four people can play two against two as partners.

Typically, a standard 52-card deck is used. The cards in play are: Ace card, 2 card, 3 card, 4 card, 5 card, 6 card, a 7 card, an 8 card, a 9 card, a 10 card, a Jack card, a Queen card, a King card, and a Joker card. Each card is assigned a value. For example, four suits of cards including spades, hearts, diamonds, and clubs, with each suit including an Ace card. The point value of each card is combined with the card value of opposing player cards to create pairs, straights, point limits, and other point objectives, garnering points for the players. The points are recorded by advancing the peg across the peg scoring holes.

It is known in the art that the objective of the Cribbage game is to be the first player to move the pegs all the way up and down the board twice and end in the in the game hole. Or put another way, to be the first to score 121 points. Note that the game ends immediately either player reaches the final hole even if this is during the play or when the dealer pegs "two for his heels". There is no requirement to get exactly 121—it is simply the first to reach the target score.

Competitions are normally played as the best of 3 games, a game being to either 61 or 121. Players take turns to deal the first hand of each game.

Typically, players cut for the deal—lowest card wins. After the first hand, players take turns to deal. The dealer shuffles, asks his opponent to cut and then deals six cards each. Both players discard two cards face down and these two cards are henceforth referred to as "the crib" or "the box". This crib is effectively an extra hand scored for the dealer. So the dealer aims to discard cards into the crib that will give a good chance of a high scoring hand whereas the opponent aims to confound this objective. Most of the skill in the game of Cribbage is down to the choice of cards discarded at this point. Next the dealer asks his opponent to cut the cards another time. The top portion of cards is placed underneath the lower portion and the new top-most card is turned face upwards. If this card is a Jack, the dealer pegs two points and says "Two for his heels".

In general, the opposing player begins play by laying one of his four cards face up while clearly stating its numerical value. All royal cards count ten, the ace counts one and other cards are worth their pip value. The dealer then lays a card separately in front of himself and announces the total of both cards. Play continues like this with each player alternately laying a card on the pile in front of him while verbally keeping tally of the current joint total. The total must not go above 31, however.

Often, when a player cannot play without taking the total above 31, that player says "go" and, if possible, the remaining player must carry on alone until that player, too, cannot play without taking the total above 31. When neither player can play any card without taking the total above 31, the player who laid the last card pegs 1 point saying "One for last". Should either player manage to take the total to exactly 31, that player pegs 2 points instead of 1, saying "Two for thirty-one". Then the cards already played are turned over and the player who did not lay the last card starts a new play. When one player's cards are exhausted, the other player continues alone. The last card played scores 1 "for last" (unless the amount is 31 in which case 2 points are scored).

Typically during play, the following events are scored and the appropriate amounts are immediately recorded on the cribbage board. If any player lays down a card which brings the total to 15, 2 points are scored. If any player lays down a card of the same type as the previous one, 2 points are scored ("2 for a pair"). In this context, the numerical value is not used so, for instance, a Jack cannot be paired with a Queen. If any player lays down a third card of the same type, 6 points are scored ("6 for a pair royal"). If any player lays down a fourth card of the same type, 12 points are scored "12 for a double pair royal"). If any player lays down a card such that with the two preceding cards, a run can be scored, 3 points are scored. The cards do not have to be of the same suit nor do they have to have been laid in sequential order. Aces count low so Queen, King, Ace is not a run. Similarly, if any player lays a card such that with the three or more preceding cards, a run can be constructed, the number of cards which would make up that run are scored. e.g. suppose cards were laid in the following order: 8,6,4,5,7. The fourth card would score 3 points, the fifth card would score five points.

Generally, each player counts the score of the four cards in his hand plus the turned up card. The non-dealer shows first and this is important because it can often make the difference between winning and losing. Fifteen—All combinations of cards that add up to fifteen count 2 points. A pair, a pair royal or a double pair royal—count 2, 6 or 12 respectively. A run—A point for each card in a run. A flush—Four or five cards of the same suit. A point is scored for each card. A 4-point flush can only be scored using cards from the hand. The turned up card can ONLY be used in a five card flush.

Typically, flushes do not count in the play. One for his nob—a jack of the same suit as the turned up card. This is always scored last so that the score is tallied by finishing with the satisfying phrase "and one for his nob". The highest possible score in the show is 29 points—3 fives and a Jack in the hand with the turned up card another five of the same suit as the held Jack. Finally, the dealer counts the score of the cards in the crib plus the turned up card and adds these points to his total. Scoring is done in exactly the same way as for the show except that a crib can only score a flush if all five cards are of the same suit for five points.

Other proposals have involved variations on the game of Cribbage. The problem with these Cribbage games is that they do not level the playing field by allowing each player to deal five times. Also, the capacity to request a re-deal, re-cut, fifth card for play, and request to see the opponent's hand of cards is not taught. Also, a Cribbage game board with 131 peg holes is not taught. Even though the above cited Cribbage card games meets some of the needs of the market, a universal cribbage board for multi-variation cribbage games and method of play that provides a universal cribbage board that is configured for play with the Cribbage card game, defined by a scoring track that is continuous, color-coded, and extended to accommodate various versions of the traditional Cribbage card game; and further includes a method of playing variations of the traditional Cribbage card game that are fundamentally the same as the traditional Cribbage card game, but differ in the card scoring combinations, final scores, sequences of playing the cards, dealer advantages, strategic options, alternative point values, and different odds, in addition to the normal rules of the traditional Cribbage card game, is still desired.

SUMMARY

Illustrative embodiments of the disclosure are generally directed to a universal Cribbage board for multi-variation cribbage games and method of play. The Cribbage game provides a universal Cribbage game board configured to mark points accumulated during card play. The Cribbage game board is configured for play with multiple variations of the traditional Cribbage card game. The game board has a continuous scoring track that is color-coded and extended to 131 peg holes to accommodate different versions of the traditional Cribbage game. A method of playing variations of the traditional Cribbage card game that are fundamentally the same as the traditional Cribbage game, but differ in the card scoring combinations, final scores, sequences of playing the cards, dealer advantages, strategic options, alternative point values, and different odds, in addition to the normal rules of the traditional Cribbage card game. The versions of the Cribbage game include a Holtey 500 Cribbage game, a Dealer's Cribbage game, and a Magic Cribbage game.

In one aspect a method of playing a Holtey 500 Cribbage game, comprises an initial Step of providing a deck of cards and a game board, the game board comprising a pair of continuous scoring tracks defined by a first section, a second section, a third section, and a fourth section, each section having a starting peg hole and an ending peg hole, each section having a unique indicium.

Another Step includes providing multiple sets of playing pegs, each set of playing pegs having a unique indicium.

In some embodiments, a Step comprises placing the playing pegs in the starting peg hole of a corresponding section of the scoring tracks. As the players accumulate points, the playing pegs advance along their respective sections, as described below.

Another possible Step can include shuffling the deck of cards. The dealer shuffles the entire deck and offers the cards to the other player(s) to cut.

In some embodiments, a Step may include dealing each player a hand of six cards from the deck of cards.

A Step includes allowing each player to deal five times during the game. Each player receives five deals.

In some embodiments, a Step may include placing, by each player, two cards from the dealt hand of cards into a Crib. Each player picks up the six dealt cards and discards two cards face-down from the six cards. Those four Crib cards (two from each player) go into the Crib, forming a third hand of four cards that the dealer uses to produce points.

A Step comprises cutting a Starter card from the deck of cards. The Starter card becomes part of all three hands, the dealer's hand, the non-dealers hand, and the Crib.

The method may further comprise a Step includes playing, by each player, at least one card from the dealt hand to form a first scoring combination. The first scoring combination generates points for the players, based on the type of scoring combination.

In some embodiments, a Step comprises audibly counting points that are scored. The player must audibly indicate to the other players the running count of points produced by playing the card.

A subsequent Step includes audibly indicating if a player cannot play a card without causing the card count of all the played cards to exceed 34 points. In one non-limiting embodiment, if the player has to exceed 34 points, the player must call "Go". The opposing player(s) then continue to play until no player can play without the count exceeding 34 points. If a player fails to audibly count any points in the hand or crib, the opposing player can call "muggings," and score these points for himself.

A Step includes advancing, by each player, the first set of pegs along the first section of the scoring tracks, in correspondence with the scored points from the first scoring combination. As the peg advances, it is significant to note that one scoring peg hole equates to one point. And the two pegs hop over each other in alternating advancements, so that the game board always shows how many points are recorded on the last score.

The method further includes a Step of playing, by each player, at least one card from the dealt hand, and the Starter card to form a second scoring combination. The second scoring combination is produced scoring 4 points by playing the cards in the player's hand, and the Starter card that is cut from the deck of cards.

A Step comprises advancing, by each player, the peg into the scoring peg holes along a second section of the scoring tracks, in correspondence with the scored points produced from the second scoring combination. The second scoring lane is actually the third lane in starting from the outside of the board. This is because the third lane is actually the second lane in from the outside of the board.

The method further includes a Step of playing, by each player, the Starter card, and the cards in the Crib, so as to form a third scoring combination. The Starter card and the Crib cards are counted in multiple combinations, so as to tally points. In one embodiment, the third scoring combination from playing the Starter card and the cards in the Crib produces 6 points.

A Step includes advancing, by each player, the peg into the scoring peg holes along a third section of the scoring tracks, in correspondence with the scored points produced from the third scoring combination.

A final Step includes winning the game by scoring the most points tallied from the first, second, and third scoring combinations In another aspect, a method for playing Dealer's Cribbage card game, comprises an initial Step of providing a deck of cards and a game board, the game board comprising a pair of continuous scoring tracks defined by a first section, a second section, a third section, and a fourth section, each section having a starting peg hole and an ending peg hole, each section having a unique indicium.

The method may further comprise a Step of placing two matching pegs in a starting peg hole of the scoring tracks.

In some embodiments, a Step comprises shuffling the deck of cards.

A Step includes requesting a re-cut of the deck of cards. In this feature, the consequence of receiving a poor hand is minimized. A re-cut is marked in a Re-cut peg hole of the Privileges Section of the game board.

A Step includes dealing a hand of six cards from the deck of cards.

A Step includes selectively re-dealing. A re-deal is marked in a Re-deal peg hole of the Privileges Section of the game board.

Continuing with the method, a Step comprises placing, by each player, two cards from the dealt hand of cards into a Crib. Each player picks up the six dealt cards and discards two cards face-down from the six cards. Those four cards (two from each player) go into the Crib, forming a third hand of four cards that the dealer uses to produce points. The non-dealer places his Crib cards down first, face up, so the dealer can see them before throwing his own Crib cards face down.

In some embodiments, a Step may include playing a fifth card from the dealt hand of cards. This is referred to as "Pleading the Fifth", and is marked in a Plead The $5^{th}$ peg hole of the Privileges Section of the game board. Pleading the Fifth occurs when players desire playing five cards from their hand instead of four cards. This allows players to utilize the fifth card from their hand when scoring, instead of, or in addition to, the cut card.

A Step comprises cutting a Starter card from the deck of cards.

The method also includes a Step of requesting, by one player, that an opposing player shows the hand of cards. Requesting a "Showing" of the hand of cards is marked in a Show peg hole of the Privileges Section of the game board.

The method may further comprise a Step includes playing, by each player, a card from the dealt hand to form a scoring combination. The scoring combination may generate points for the players, based on the type of scoring combination.

In some embodiments, a Step comprises audibly counting points that are scored.

A subsequent Step includes audibly indicating if a player cannot play a card without causing the card count of all the played cards to exceed 31 or 34 points.

In some embodiments, a Step may include advancing, by each player, a playing peg into the scoring peg holes along the scoring tracks, in correspondence with the scored points.

A Step comprises producing points by playing the cards in the player's hand, the cards in the Crib, and the Starter card to form the at least one card scoring combination.

A final Step includes winning the game by scoring 121 points and advancing the playing peg to an ending peg hole of the scoring tracks In yet another aspect, a method for playing a Magic Cribbage card game, comprises an initial Step of providing a deck of cards and a game board, the game board comprising a pair of continuous scoring tracks defined by a first section, a second section, a third section, and a fourth section, each section having a starting peg hole and an ending peg hole, each section having a unique indicium.

A Step includes placing two matching pegs in a starting peg hole of the scoring tracks.

In some embodiments, a Step comprises shuffling the deck of cards.

A Step includes dealing a hand of six cards from the deck of cards.

In some embodiments, a Step may include placing, by each player, two cards from the dealt hand of cards into a Crib. Each player picks up the six dealt cards and discards two cards face-down from the six cards. Those four cards (two from each player) go into the Crib, forming a third hand of four cards that the dealer uses to produce points.

A Step comprises cutting a Starter card from the deck of cards.

The method may further comprise a Step includes playing, by each player, a card from the dealt hand to form a first scoring combination.

The method may further comprise a Step of producing points by playing the cards in the player's hand, the Starter card, the cards in the Crib card to form a second scoring combination.

In some embodiments, a Step comprises audibly counting points that are scored.

A subsequent Step includes audibly indicating if a player cannot play a card without causing the card count of all the played cards to exceed 34 points.

A Step comprises advancing, by each player, a peg into the scoring peg holes along the scoring tracks, in correspondence with the scored points, whereby one scoring peg hole equates to one point.

A final Step includes winning the game by scoring 131 points and advancing the peg to an ending peg hole.

One objective of the present invention is to provide variations on the traditional Cribbage card game.

Another objective is to provide a Cribbage game board that can be used with the Holtey 500 Cribbage game, the Dealers Cribbage game, and the Magic Cribbage game.

Yet another objective is to level the playing field by removing unfair advantages inherent in the traditional Cribbage game.

Yet another objective is to remove the advantage of the dealer by allowing all players to have 5 deals.

Yet another objective is to allow players to re-cut or re-shuffle the deck.

Yet another objective is to allow players the option to see other player's hand of cards on a limited basis.

Yet another objective is to increase the point count tally to 34 points before a player loses their turn.

Yet another objective is to provide multiple, entertaining variations of the traditional Cribbage card game.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A universal cribbage board 100 for multi-variation cribbage games and a method 300, 300, 400 of play is referenced in FIGS. 1-5. The universal Cribbage game board 100 is configured for play with the traditional Cribbage card game, and variations of the traditional Cribbage card game.

Figure 1:
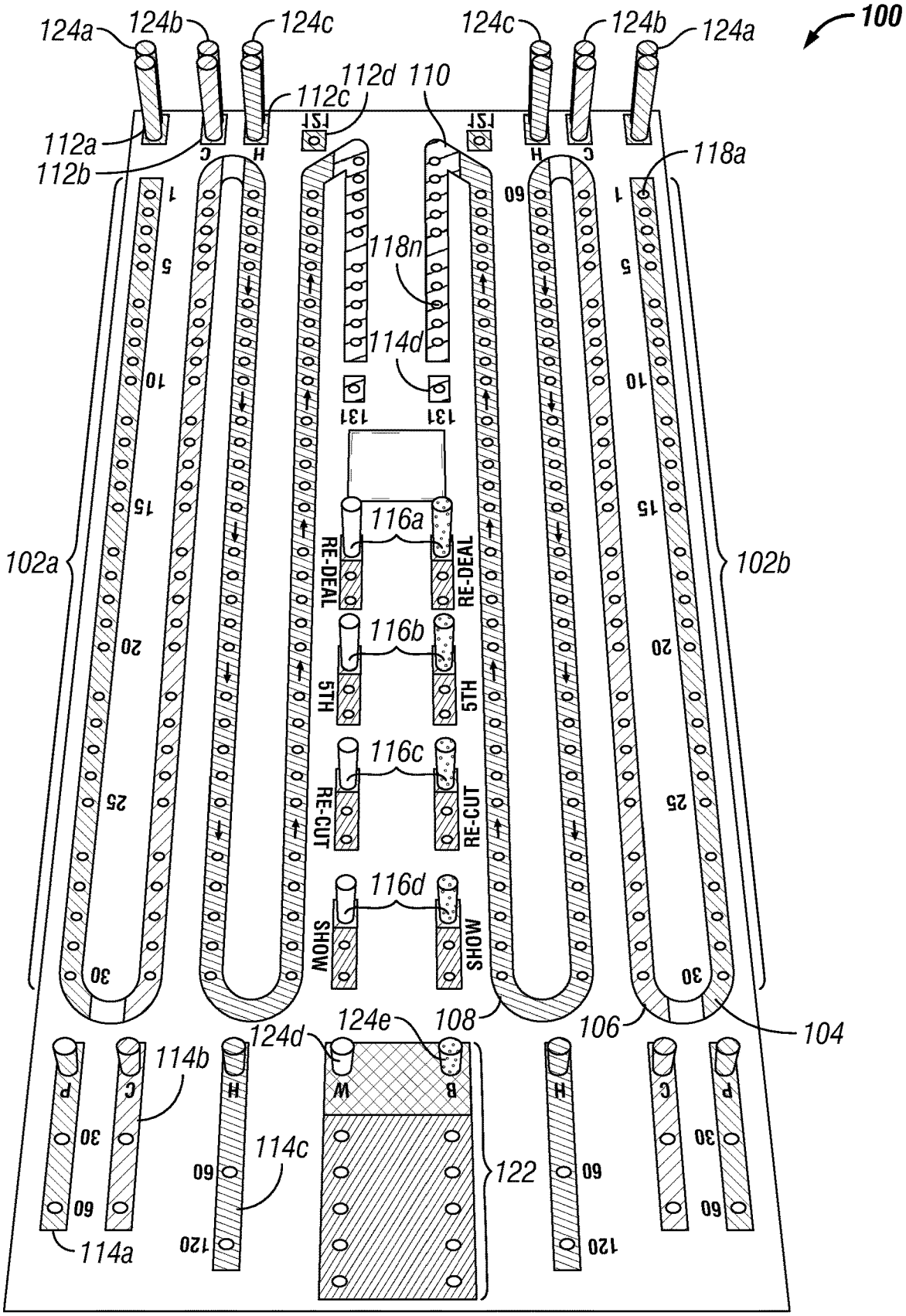
FIG. 1 illustrates a top view of an exemplary universal Cribbage game board used in playing multiple versions of a Cribbage game, in accordance with an embodiment of the present invention.

As referenced in FIG. 1, the universal Cribbage game board 100 is defined by a scoring track that is continuous, color-coded, and extended, so as to accommodate multiple versions of the traditional Cribbage card game. Each section of color along the scoring tracks are played with a variation of the traditional Cribbage card game. The scoring track comprises 130 scoring peg holes that mark points that are accumulated from playing a hand of cards. It is known in the art that the Cribbage board is used for scoring rather than the usual pencil and paper. The game board is equipped with holes that accommodate pegs. The game board works to speed up scoring, because pegging reduces the chances for errors in computing scores.

In some embodiments, a method 300 of playing the variations of the traditional Cribbage card game can be played by two or more people. Or four people can play two against two as partners. The players strategically play different sequences of playing the cards dealt to them to produce points through different point combinations of cards played against the backdrop of the traditional rules of a Cribbage card game. The player's hand of cards is strategically played against an opposing player's hand of cards and a crib hand of cards to score a winning amount of 121 or 131 points, depending on the version of Cribbage card game being played. The methods 300, 400, 500 of play includes at least three variations of the traditional Cribbage card game, which include: a "Holtey 500 Cribbage" card game; a "Dealer's Cribbage" card game; and a "Magic Cribbage" card game.

The fundamentals of the variations of the Cribbage card games are similar in many ways to that of the traditional Cribbage card game. The card scoring combinations, final scores, point values, and dealer advantages, and strategic options vary, however, for the three versions of Cribbage. Further, in all versions described herein, the players are dealt a hand of cards from a standard 52 deck of cards 200.

Figure 2:
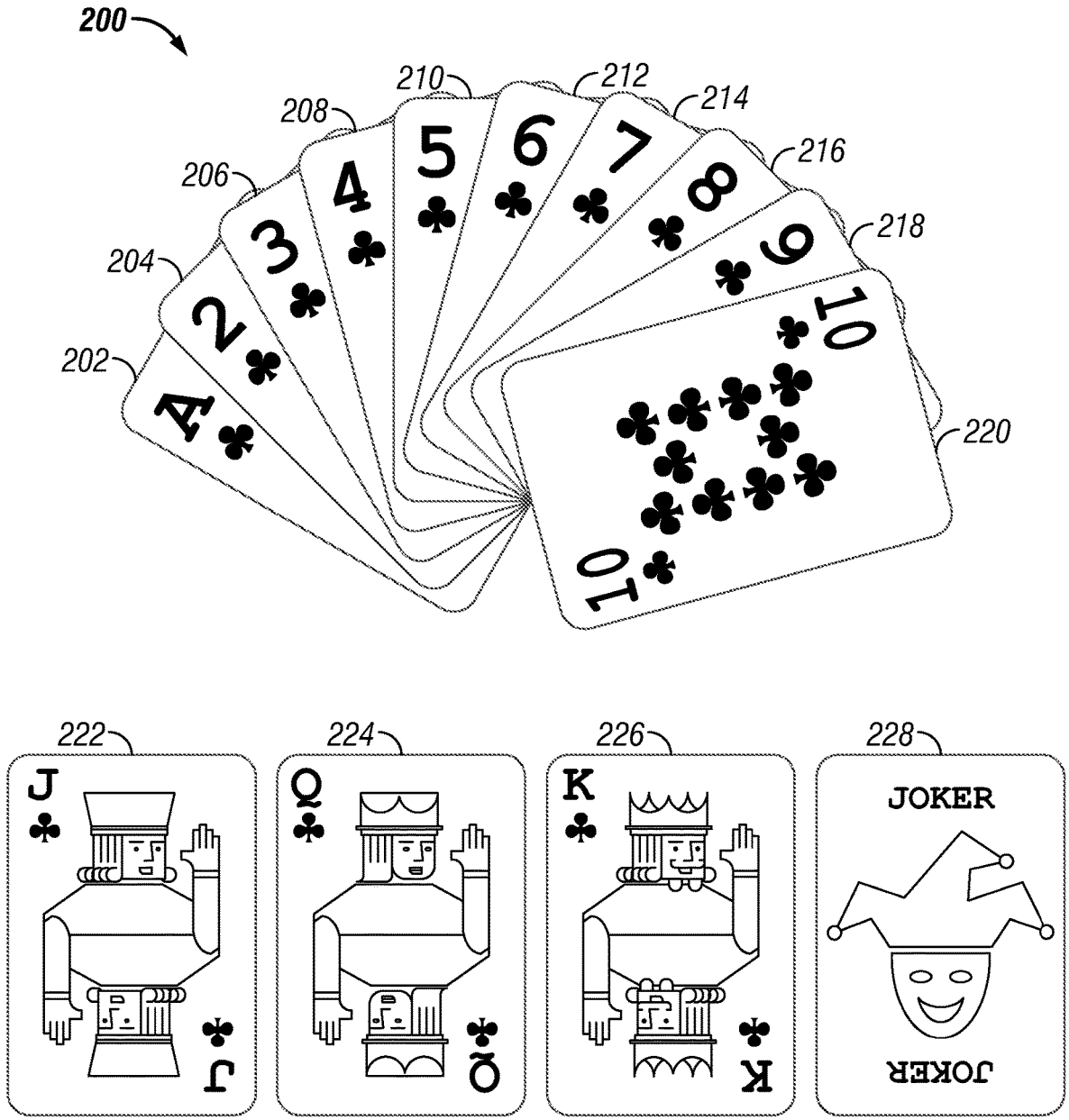
FIG. 2 illustrates a top view of a deck of cards used in playing multiple versions of the Cribbage game, in accordance with an embodiment of the present invention.

The standard 52-card deck 200 is used. As FIG. 2 illustrates, the cards in play are: Ace card 202, 2 card 204, 3 card 206, 4 card 208, 5 card 210, 6 card 212, a 7 card 214, an 8 card 216, a 9 card 218, a 10 card 220, a Jack card 222, a Queen card 224, a King card 226, and a Joker card 228. Each card is assigned a value. For example, four suits of cards including spades, hearts, diamonds, and clubs, with each suit including an Ace card. The Ace card 202 is given a value of one point. The 2-10 cards 204-220 are given a point value of two through ten points, corresponding to the face value of the card. The Jack card 222, Queen card 224, and King card 226 are given a value of ten points. The point value of each card is combined with the card value of opposing player cards to create pairs, straights, point limits, and other point objectives, garnering points for the players. The points are recorded by advancing the peg across the peg scoring holes, as described below.

Initial rules for distributing the cards 200 to the players are as follows. From a shuffled deck of cards 200 face down, each player cuts a card, leaving at least four cards at wither end of the deck. If both players cut cards of the same rank, each player redraws. The player with the lower card deals the first hand. Thereafter, the turn to deal alternates between the players, except that the loser of the game deals first if another game is played. The dealer player has the right to shuffle last, and presents the cards to the non-dealer player for the cut, prior to dealing the cards. The dealer distributes six cards face down to ach player, beginning with the opposing player. One of three versions of the Cribbage game may then commence, as described below.

The dealt hands of cards are strategically played by the players to achieve different point combinations and odds available to each player. The cards are also played to maximize the player's chance of winning based on the best offensive and defensive strategies presented in each hand of cards. Nonetheless, the strategy for playing the hand of cards is different for each variation of the traditional Cribbage card game. In one embodiment, a first version of the Cribbage card game comprises a Holtey 500 Cribbage card game. A second version of the Cribbage card game comprises a Dealer's Cribbage card game. A third variation of the Cribbage card game comprises a Magic Cribbage card game. All variations, including the traditional Cribbage card game, however, are configured to be played on the universal Cribbage game board 100, described below.

In one embodiment, illustrated in FIG. 1, the universal Cribbage game board 100 is designed to mark points accumulated during card play, such as a peg board. In some embodiments, the game board 100 is defined by a flat panel having multiple continuous scoring tracks 102*a*, 102*b*. The scoring tracks 102*a-b* include a plurality of scoring peg holes 118*a-n*. As players accumulate points during card play, the playing pegs 124*a*, 124*b*, 124*c* are incrementally advanced through the peg holes, along the scoring tracks 102*a-b* to mark the points for the players. Pegs 124*d*, and 124*e* are used to mark, or track, the number of deals by each player. One player can get a white peg 124*d*, and the other player receives a black peg 124*e*, for example.

In one non-limiting embodiment, the flat panel is a game board having a flat, rectangular configuration, as is known in the art of board games. The game board may be constructed of suitable rigid material including but not limited to wood, metal or plastic. Further, the game board 100 may fold in half for efficient stowage.

The universal Cribbage game board 100 is of the type of continuous track Cribbage boards which, as the name implies, have one continuous line of 120 scoring peg holes for each player. The universal Cribbage game board 100 is placed to one side between the two players, and each player takes two pegs 124*a-d* of the same color. (The pegs are placed in the game holes until the game begins.) Each time a player scores, they advance a peg along a row on their side of the board, counting one hole per point. Two pegs are used, and the rearmost peg jumps over the first peg to show the first increment in score. After another increase in score, the peg behind jumps over the peg in front to the appropriate hole to show the player's new score, and so on. In one possible embodiment, the players "go down" (away from the game holes) on the outer rows and "come up" on the inner rows.

In one embodiment of the game board 100, the continuous scoring track is defined by 120 peg holes representing a total of 120 points in the traditional Cribbage card game. In other embodiments, the continuous scoring track has an additional 10 peg holes appended to the 120 peg holes, for a total of 130 peg holes; thereby representing a total of 130 points for playing a third variation of the traditional Cribbage card game. In yet another embodiment, both the 120 peg hole, and the 130 peg hole versions are on the same game board 100, but color-coded to differentiate therebetween.

In one non-limiting embodiment, the universal Cribbage game board 100 comprises two separate scoring tracks 102*a*, 102*b*—one for each player. A central panel separates each track 102*a*, 102*b*. After drawing a card, and scoring points, the players advance a peg along the scoring peg holes 118*a-n* in the continuous scoring tracks 102*a*, 102*b* to tally and mark points that scored from playing the hand of cards. The general goals of the game are to start at a starting peg hole 112*a-c* at a first terminus of the scoring tracks 102*a*, 102*b*; accumulate a maximum number of points based on playing of the cards, and traverse the scoring tracks 102*a*, 102*b* until reaching an ending peg hole 114*a-c* disposed at the opposing terminus of the scoring tracks 102*a*, 102*b*. Thus, the starting points for both players are 124*a*. The terminus for both players is 112*d*.

Each player attempts to place the peg(s) into the ending peg hole 114*a-d* before opposing player(s) reach the ending peg hole 114*a-d*. A first ending peg hole 114*a* begins at first section 104 of scoring tracks 102*a-b*. A second ending peg hole 114*b* begins at second section 106 of scoring tracks. A third ending peg hole 114*c* begins at third section 106 of scoring tracks. A fourth ending peg hole 114*d* begins at fourth section 108 of scoring tracks. Thus, the starting points for both players are 124*a*. The terminus for both players is 112*d*.

Each player, or team, is assigned one of the two scoring tracks 102*a-b*. In one non-limiting embodiment, the scoring tracks 102*a-b* follow an S-shaped path. The scoring tracks 102*a-b* are defined by 130 scoring peg holes 118*a-n* representing a total of 130 points in the multiple variations of the Cribbage card game. In one non-limiting embodiment, the scoring peg holes 118*a-n* are defined by indicia distinguishing the scoring peg holes 118*a-n* from each other. The indicia may include digits from 1 to 130, with each indicium representing a single point. Though in other embodiments, indicia are not displayed with each scoring peg hole.

In one embodiment, the continuous scoring tracks 102*a-b* uses three distinct colors of rows to differentiate between the different versions of the traditional Cribbage card game. The scoring tracks 102*a-b* are also defined by a first section 104 having a first color, a second section 106 having a second color, a third section 108 having a third color, and a fourth section 110 having a fourth color. The colors are a form of color-coding sections of the scoring tracks 102*a*, 102*b* for different variations of the Cribbage card game.

In one non-limiting embodiment, the first color 104 is green; the second color is 106 is red; the third color 108 is yellow; and the fourth color 110 is purple. In another embodiment, the 10 additional peg holes that complete 130 peg holes are color-coded (purple) to indicate a different variation from the traditional Cribbage card game. Any combination of colors or patterns may be used to distinguish between sections 104, 106, 108, 110 of the scoring tracks 102*a-b*.

In some embodiments of the universal Cribbage game board 100, the first, second, and third sections 104, 106, 108 of the scoring tracks 102*a*, 102*b* are defined by 120 scoring peg holes. These first three sections of the scoring track are played with the first version of the Cribbage card game (Holtey 500 Cribbage card game), and the second version of the Cribbage card game (Dealer's Cribbage card game).

Further, the first, second, third sections 104, 106, 108; and additionally, the fourth sections 110 of the scoring tracks 102*a*, 102*b* are played with the third version of the Cribbage card (Magic Cribbage card game). The fourth section 110 of the scoring track is required because Magic Cribbage card game is a higher scoring game, and thus, requires more scoring peg holes.

Continuing with the configuration of the universal Cribbage game board 100, the scoring tracks 102*a*, 102*b* also include a Privileges Section 116*a-d*. This can include four sets (eight rows) of privilege peg holes 116*a-d*, which are disposed adjacent to the ending peg hole 114*a-d*. The Privilege Section 116*a-d* are used to mark unique playing features of the second variation of the Cribbage card game (Dealer's Cribbage card game). This is because the second variation requires playing with such privilege rules—designed to make the game livelier and more dynamic.

The privilege peg holes 116*a-d* can be disposed as four separate rows of privilege peg holes 116*a*, 116*b*, 116*c*, 116*d* arranged in a parallel, spaced-apart relationship with a corresponding four rows of privilege peg holes. These include: Re-deal peg holes 116*a*, where players request a hand be redealt; Plead the Fifth peg holes 116*b* where players utilize a fifth card from their dealt cards; Re-cut peg holes, where players request the deck be re-cut; Show peg holes 116*d*, where a player can request to see the opposing players hand of cards. Additionally, a card dealing section 122 of the game board 100 allows players to mark the deal, or distribution of cards.

Turning now to FIGS. 3A-5B, the method of playing the traditional Cribbage card game requires the universal Cribbage game board 100 (FIG. 1), described above, and a standard deck of cards 200 (FIG. 2). The three versions of the Cribbage game are substantially the same, expect for a few scoring and card dealing variations. In all three methods 300, 400, 500 of playing the Cribbage game, two players may play the game. It is also possible that more than two players (3 or 4, and up to 8) play, forming 2-4 teams or playing individually. One of the players serves as the dealer.

Initially, each player places two matching pegs 124*a-d* in the start peg holes 112*a-d* of their respective scoring track 102*a*, 102*b*. The deck of cards 200 is then shuffled by the dealer, who is one of the players. Next, the dealer distributes each player a hand of at least four cards from the deck of cards 200. In one embodiment, six cards are initially distributed by the dealer. Next, each player places two cards from the dealt hand of six cards into a crib. The crib is formed for future point scoring in a card counting portion of the Cribbage card game. The cut-card from the initial deck of cards becomes the fifth card of each player's hand and of the crib hand.

The first player, who serves as the dealer, cuts a starter card from the deck of playing cards. The players then sequentially play cards from their hand of cards. As each player plays a card, they audibly call out the point value of the card being played. The point value for the cards is as follows: The Jack card 222, Queen card 224, and King card 226 count ten points each; the Ace card 202 counts one point; and every other card counts its face value. The players have to audibly count any points that are scored. Failing to audibly count out points can be penalized, as described below. Audibly calling out played cards continues as the players take turns announcing a running total of points reached by the addition of the last card to all of those previously played. For example, the non-dealer player begins with a 4 card 208, saying "Four." The dealer then plays a 9 card 218 and audibly calls "Thirteen."

The players strategically play cards to achieve a scoring combination. One scoring combination is a "15 Combination", where the sum of the cards is 15. For example, in the "15" card scoring combination, the card played brings the running total of cards played to achieve the "15 Combination". This scores 2 points for the player who dealt the last card. The peg 124*a* is then advanced 2 spaces, corresponding to the 2 points. Every "15 Combination" created from the player's hand and crib scores 2 points. For example, a 5 card 210 and a 10 card 220 sum up to a "15 Combination". A 7 card 214 and an 8 card 216 also sum up to a "15 Combination". Other "15 Combinations" include: 3-2-10 cards, 4-5-6 cards, etc.

In another card scoring combination, a "Pair Combination" of same cards scores 2 points. Thus, when a card is played that is the same value (or same face-card rank) as the prior played card the "Pair Combination" wins 2 points in each hand or crib.

In another card scoring combination, 6 points are scored if the played card is the "Third of a Kind" sequentially in card play. The "Third of a Kind" scores 6 points in each hand or crib. For example, three sequential King cards constitute a "Third of a Kind".

In another card scoring combination, 12 points are scored if the played card is the "Fourth of a Kind" sequentially in card play. The "Fourth of a Kind" scores 6 points in each hand or crib. For example, four sequential cards having the same coat constitute a "Fourth of a Kind".

In yet another card scoring combination, 3 points are scored for a "Run Combination", or sequential play, of 3 cards during card play. These cards do not need to be of the same suite, and may include, for example, Ace-2-3, or 10-Jack-Queen. To score a "Run Combination" in card play, the cards do not need to be played in exact order. For example, the play could be 10, Queen, Jack; and the player that plays the Jack scores 3 points. Similarly, a "Run Combination" of four cards scores 4 points. And a "Run Combination" of five cards scores 5 points.

In yet another card scoring combination, a hand such as 6, 7, 7, 8 is a "Double Run of Three Combination". The player scores one run of 3 using one 7 card, and another run of 3 using the other 7 card, for a total of 6 points. The player also scores an additional 2 points for the pair of 7 cards; and, in the case of this hand, scores 4 more points for the two combinations of 15 made with the 7 cards and the 8 card. The "Double Run of Three Combination" scores 12 points in total.

In yet another card scoring combination, 4 cards of the same suit played in sequence during card play is a "Double Run of Four Combination", which scores 4 points; a flush of 5 scores 5 points, and so on. To score a flush in the hand or crib, all 4 cards must be of the same suit; and if the cut card matches, 5 points are scored. Players cribbage may choose not to count a 4-card flush in the crib, and only allow a flush in the crib when the cut card matches to make a 5-card flush for 5 points.

In yet another card scoring combination, 2 points are scored for the player who is the dealer, if the cut card is a Jack card 222.

In yet another card scoring combination, 1 point is scored, if the player has a Jack card in the hand or crib that is the same suit as the cut card.

In yet another card scoring combination, if a player cannot play without causing the card count to exceed 31, the player audibly calls "Go". The other player continues to play until no one can play without the count exceeding 31. Once 31 is reached or no one is able to play, the player who played the last counted card scores 1 point if the count is under 31 or 2 points if the count is exactly 31. The count is then reset to zero, and play commenced. Further, if a player fails to audibly count any points in the hand or crib, the opposing player can call "muggings," and score these points for himself. This card scoring combination is optional, much like counting the 4-card flush in the crib. In this manner, the players continue tallying a counting value of each player's hand and the crib until a player has accumulated a winning number of points, which in the traditional Cribbage card game is 121 points.

The game board 100 serves to mark this accumulation of points. Thus, after achieving points from the aforementioned scoring combinations, the players advance their respective pegs along the scoring tracks 102*a-b* in accordance with points scoring during playing of the hand of cards. After the players exhaust their cards, the players begin the second phase of the game—counting the remaining un-played cards and the cards that were placed in the crib. The cards are counted in multiple scoring combinations, so as to accumulate points. The counting involves different scoring rules than the playing of cards discussed above. Each player is responsible for identifying their own point combinations. So, if a player does not recognize that a scoring combination has been achieved, that player loses the points. Furthermore, the non-dealer scores the points first, and then the dealer scores.

In implementing the card scoring combinations with the universal Cribbage game board, each player places two pegs 124*a*, 124*b* in the starting peg hole 112*a-d* of their respective colored scoring track 102*a-b* on their side of the game board 100. A first starting peg hole 112*a* begins at first section 104 of scoring tracks 102*a-b*. A second starting peg hole 112*b* begins at second section 106 of scoring tracks. A third starting peg hole 112*c* begins at third section 106 of scoring tracks. Peg hole 112*d* is never used as a starting point, but only used as a terminus for the traditional cribbage game. Playing peg 124*a* is, however, the starting point for both players and 112*d* is the terminus.

The Universal Cribbage board has a convenient continuous track of 120 holes for easy counting and marking of points. Players advance along the scoring track, based on the points achieved by playing their cards to achieve scoring combinations. The first player to advance the playing pegs from starting point 124*a*, and reach the ending peg hole 112*d* ("peg out" hole) at the terminus of the scoring track, is the winner. For the prior art board, the multiple scoring lanes are never used in conjunction with the continuous lane.

As discussed above, the method of play with the universal Cribbage game board includes a method 300 of playing "Holtey 500 Cribbage" card game; a method 400 of playing a "Dealer's Cribbage" card game; and a method 500 of playing a "Magic Cribbage" card game.

A first variation of the traditional Cribbage card game is a Holtey 500 Cribbage card game. The most significant variance from the traditional Cribbage game taught in a method 300 of playing the Holtey 500 Cribbage card game, include:

1) Each player receives a fair chance to deal 5 hands of cards. Thus, the advantage of the dealer is removed from the game. Thus, the highest total number of points scored by a player after 10 hands in the game determines the winner. This unique rule removes two elements of unfairness, which are the "head-start" that is allotted to the dealer in traditional Cribbage card game; and the occasion when the non-dealer can reach 121 points before the dealer has a chance to count the hand and crib points.
2) Three different scoring combinations tracked on three sections of the scoring track, i.e., players hand, Starter card and players hand, and Starter card and Crib cards scoring combinations. The scoring combinations are tallied to achieve a final score.
3) The card play count limit is 34. Players play cards and score points that reach a running total of 34 points before losing their turn. The traditional Cribbage game only allowed the point tally to reach 31. This game is not a race; the first player to achieve the winning points is the winner.
4) First player to reach 500 points wins.

Figure 3:
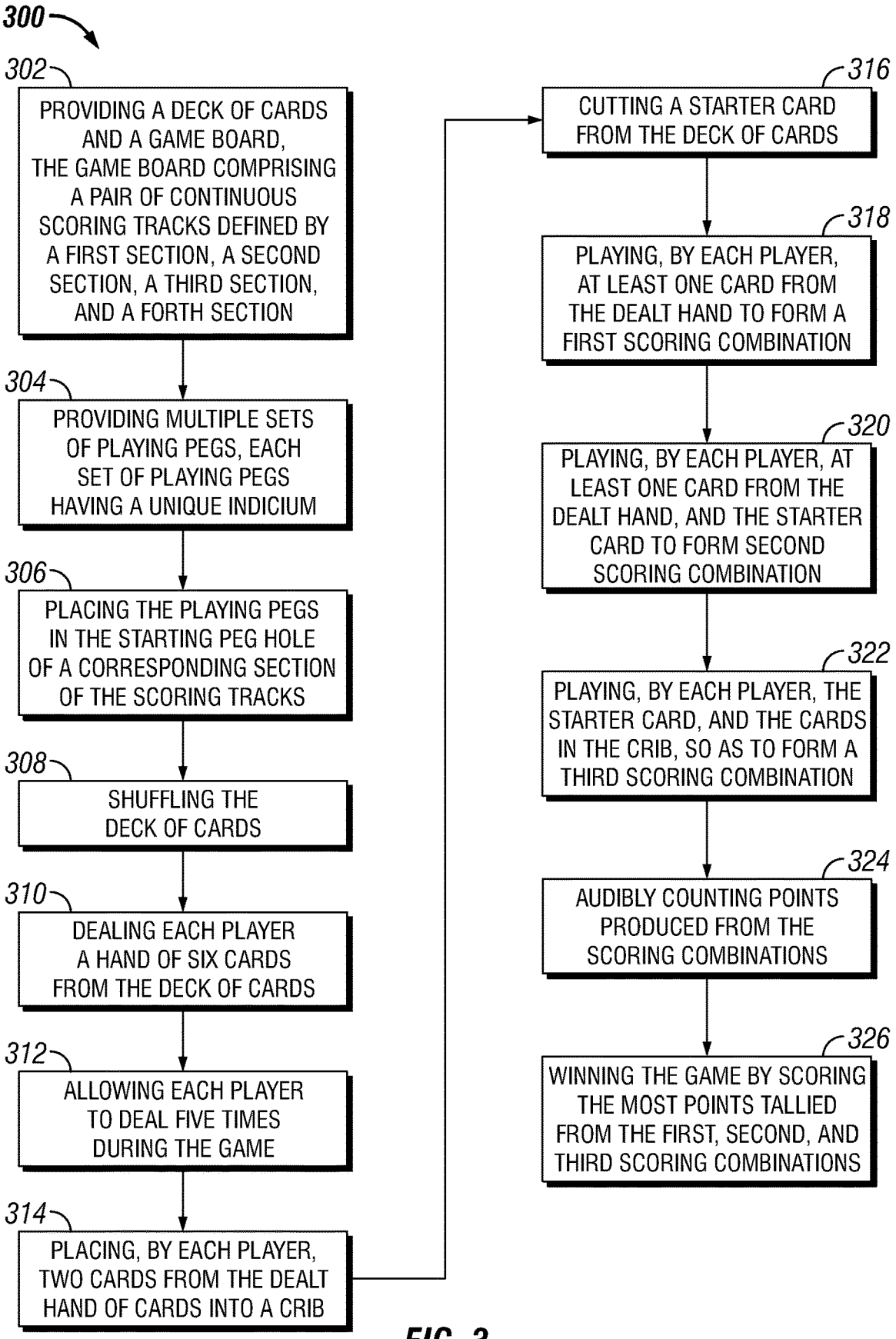
FIG. 3 illustrates a flowchart of an exemplary method of playing a Holtey 500 Cribbage card game with a universal Cribbage game board, in accordance with an embodiment of the present invention.

As referenced in flowchart of FIG. 3, a method 300 of playing the Holtey 500 Cribbage card game with a universal Cribbage game board, includes an initial Step 302 of providing a deck of cards and a game board, the game board comprising a pair of continuous scoring tracks defined by a first section 104, a second section 106, a third section 108, and a fourth section 110, each section having a starting peg hole 112*a-d* and an ending peg hole 114*a-c*, each section having a unique indicium, such as a color. It is significant to note that with the Holtey 500 Cribbage configuration of the game, the fourth section 110 of the scoring track is not utilized.

The method 300 may further comprise a Step 304 of providing multiple sets of playing pegs, each set of playing pegs having a unique indicium. In one non-limiting embodiment, four sets of playing pegs are utilized for the Holtey 500 Cribbage game. The players place two matching pegs in the starting peg holes for each section of the scoring tracks. The players each use two pegs to record their points. When a player scores the first points of the game, one peg is placed in the first peg hole after the starting peg hole 124*a*. And as the player scores subsequent points, the trailing peg hops over the leading peg so that the game board always shows how many points are recorded on the last score. It is significant to note that there is no "advancing pegs down back the inside of the scoring track in the Holtey 500 version of the Cribbage game. Except on the 60 hole track for scoring hand points, which starts at 124*c*. This is because the Holtey 500 version of the Cribbage game does not use the continuous scoring track.

In some embodiments, a Step 306 comprises placing the playing pegs 124*a-c* in the starting peg holes 118*a-n* of a corresponding section of the scoring tracks. As the players accumulate points, the playing pegs advance along their respective sections, as described below. The playing pegs at the ending peg hole of each section marks the player's count when the player reaches a score of 30 or 60 points in the first or second sections; or 120 points in the third section. The deal count is tracked with the white and black colored pegs 124*d*, as illustrated in FIG. 1.

In some embodiments, the playing pegs may include green colored pegs, red colored pegs, yellow colored pegs, white colored pegs, and black colored pegs. The green colored pegs 124*a* are used in the first section of the scoring track to mark points on the game board for scoring card play points. Thus, as the player plays a card to achieve points through a scoring combination, the green colored pegs advance along the first section 104. The red colored pegs 124*b* mark points on the game board for scoring points from the Crib and Starter card. The yellow colored pegs 124*c* mark points for hands of cards played with the Starter card.

Furthermore, a single white colored peg 124*d* may be used to mark the deal count for one player (or team), and a single black colored peg 124*e* may be used to mark the deal count for the other player (or team) or the number of card distributions by the dealer in the game. The white and black colored pegs are not functional to record points, but rather for marking which players deal in order, so as to avoid confusion. Any color peg may, however, be used with any section of the scoring track, as long as the peg colors are unique for quick visual differentiation during play.

Another possible Step 308 can include shuffling the deck of cards. The dealer shuffles the entire deck and offers the cards to the other player(s) to cut. Both players cut the deck, and whoever draws the lowest card is the dealer. The deal alternates between players for each hand in the game thereafter.

In some embodiments, a Step 310 may include dealing each player a hand of six cards from the deck of cards. The dealer deals six cards from the deck of cards 200, one at a time, to both players. The deck of cards is never placed on the game board through.

A Step 312 includes allowing each player to deal five times during the game. Rather than one player starting to the game by dealing; and thereby receiving an extra opportunity to deal, each player receives five deals. It is significant to note that an equal number of deals for each player removes the disadvantage that the non-dealer player has by receiving less deals. Pegs 124*d*, and 124*e* are used to mark, or track, the number of deals by each player. One player can get a white peg 124*d*, and the other player receives a black peg 124*e*, for example.

In some embodiments, a Step 314 may include placing, by each player, two cards from the dealt hand of cards into a Crib. Each player picks up the six dealt cards and discards two cards face-down from the six cards. Those four Crib cards (two from each player) go into the Crib, forming a third hand of four cards that the dealer uses to produce points. Thus, the dealer aims to discard cards into the Crib that give a good chance of a high scoring hand; whereas the opposing player aims to confound this objective.

A Step 316 comprises cutting a Starter card from the deck of cards. After both players decide which four cards to keep, the non-dealer player cuts the remaining cards of the stock, and the dealer turns over the top card of the cut deck to reveal the Starter card. The Starter card essentially becomes part of all three hands, the dealer's hand, the non-dealers hand, and the Crib. The Starter card is not, however, included in cards that are played by the players.

The method 300 may further comprise a Step 318 includes playing, by each player, at least one card from the dealt hand to form a first scoring combination. The first scoring combination generates points for the players, based on the type of scoring combination. The card that is played may also not be effective in scoring points if no scoring combination is possible. The players alternate playing their cards to create scoring combinations off each other.

The traditional scoring combinations, in addition to first scoring combinations unique to Holtey 500 Cribbage are both used by players to produce points. Furthermore, in the Holtey 500 Cribbage game, a player scores 3 points by playing a card to form the card scoring combination. The traditional scoring combinations are as follows:

In a first traditional scoring combination, the players strategically play cards to achieve a "15 Combination", where the sum of the cards is 15. For example, in one "15" card scoring combination, the card played brings the running total of cards played to achieve the "15 Combination". This scores 2 points for the player who dealt the last card. The peg 124*a* is then advanced 2 spaces, corresponding to the 2 points. Every "15 Combination" created from the player's hand and crib scores 2 points. For example, a 5 card 210 and a 10 card 220 sum up to a "15 Combination". A 7 card 214 and an 8 card 216 also sum up to a "15 Combination". Other "15 Combinations" include: 3-2-10 cards, 4-5-6 cards, etc.

In another traditional scoring combination, a "Pair Combination" of same cards scores 2 points. Thus, when a card is played that is the same value (or same face-card rank) as the prior played card the "Pair Combination" wins 2 points in each hand or crib.

In another traditional scoring combination, 6 points are scored if the played card is the "Third of a Kind" sequentially in card play. The "Third of a Kind" scores 6 points in each hand or Crib cards. For example, three sequential King cards constitute a "Third of a Kind".

In another traditional scoring combination, 3 points are scored if the played card is the "Fourth of a Kind" sequentially in card play. The "Fourth of a Kind" scores 3 points in each hand or crib. For example, four sequential cards having the same coat constitute a "Fourth of a Kind".

In yet another traditional scoring combination, 3 points are scored for a "Run Combination", or sequential play, of 3 cards during card play. These cards do not need to be of the same suite, and may include, for example, Ace-2-3, or 10-Jack-Queen. To score a "Run Combination" in card play, the cards do not need to be played in exact order. For example, the play could be 10, Queen, Jack; and the player that plays the Jack scores 3 points. Similarly, a "Run Combination" of four cards scores 4 points. And a "Run Combination" of five cards scores 5 points.

In yet another traditional scoring combination, a hand such as 6, 7, 7, 8 is a "Double Run of Three Combination". The player scores one run of 3 using one 7 card, and another run of 3 using the other 7 card, for a total of 6 points. The player also scores an additional 2 points for the pair of 7 cards; and, in the case of this hand, scores 4 more points for the two combinations of 15 made with the 7 cards and the 8 card. The "Double Run of Three Combination" scores 12 points in total.

In yet another traditional scoring combination, 4 cards of the same suit played in sequence during card play is a "Flush", which scores 4 points. To score a flush in the hand or crib, all 4 cards must be of the same suit; and if the cut card matches, 5 points are scored. Players may choose not to count a 4-card flush in the crib, and only allow a flush in the crib when the cut card matches to make a 5-card flush for 5 points.

In yet another traditional scoring combination, 2 points are scored for the player who is the dealer, if the cut card is a Jack card 222. In yet another traditional scoring combination, 1 point is scored, if the player has a Jack card in the hand or crib that is the same suit as the cut card. In this manner, the players continue tallying a counting value of each player's hand and the crib until a player has accumulated a winning number of points, which in the traditional Cribbage card game is 121 points.

In addition to the card scoring combination of the traditional Cribbage game described above, Holtey 500 Cribbage game provides additional scoring combinations. In one card scoring combination, 4 card flushes can be scored in the crib. This is different than the traditional Cribbage, where a flush is only counted if the 4 cards match the cut-card, which scores 5. In another card scoring combination, a 5-card straight flush receives 15 points. In yet another card scoring combination, only 1 point is given to the dealer when a jack is cut.

For the Holtey 500 Cribbage, the scoring combinations produce different points than the traditional scoring combination points. In one embodiment of the Holtey 500 Cribbage game, a player scores 3 points by playing a card that corresponds to the opposing player's cards to form at least one card scoring combination.

Thus, the variance in the scoring system includes: every score in player card play receives 3 points; every score in the hand count (Starter card) receives 4 points; and every score in the Crib count receives 6 points. Thus, raising the value of the Crib score to 6 points necessitates the application of skill in every facet of the Holtey 500 Cribbage card game. Non-dealer and dealer alike are forced to consider the two cards placed in the crib more thoughtfully. The change of the crib score value to 6 creates greater emphasis on this portion of the card game.

The alteration of the value of the card play scores from 6 down to 3 is because the card play portion of the game requires the least amount of skill or knowledge of the game, and is most governed by luck. Thus, in the Holtey 500 Cribbage card game, the value is reduced to 3 from the point value of 6 in Holtey 500 Cribbage for the card playing portion. Those skilled in the art will recognize that it is difficult to calculate the odds of the opposing player having a pair to match the played card, or a third to triple the pair; or a fourth to quadruple it. Thus, because less skill is required, the emphasis and amount of potential points to be gained are reduced.

A Step includes advancing, by each player, the first set of pegs 124*a* along the first section of the scoring tracks, in correspondence with the scored points from the first scoring combination. As the peg advances, it is significant to note that one scoring peg hole equates to one point. And the two pegs hop over each other in alternating advancements, so that the game board always shows how many points are recorded on the last score.

The method 300 further includes a Step 320 of playing, by each player, at least one card from the dealt hand, and the Starter card to form a second scoring combination. The second scoring combination produces points by playing the cards in the player's hand, and the Starter card that is cut from the deck of cards, as taught in Step 314. The player cards and the Starter card are counted in multiple combinations, so as to tally points. The value of the hand points stay the same as in the original 500 Cribbage card game, at 4 points each. And the point value is greater than the card play portion because it is easier to develop a higher scoring hand when the player can choose from four of the six cards dealt. Another benefit is that another player is prevented from being a "saboteur" by purposefully throwing poor cards into the players' hand, as can be done in the Crib.

A Step comprises advancing, by each player, the pegs 124*b* into the scoring peg holes along the second section of the scoring tracks, in correspondence with the scored points produced from the second scoring combination.

The method 300 further includes a Step 322 of playing, by each player, the Starter card, and the cards in the Crib, so as to form a third scoring combination. The Starter card and the Crib cards are counted in multiple combinations, so as to tally points. In one embodiment, the third scoring combination from playing the Starter card and the cards in the Crib produces points with a value of 6.

Another Step includes advancing, by each player, the pegs 124*c* into the scoring peg holes along the third section of the scoring tracks, in correspondence with the scored points produced from the third scoring combination.

Another Step includes advancing, by each player, the pegs 124*d* into a dealers section of the game board 100.

In some embodiments, a Step 324 comprises audibly counting points that are scored. The player must audibly indicate to the other players the running count of points produced by playing the card.

A subsequent Step includes audibly indicating if a player cannot play a card without causing the card count of all the played cards to exceed 34 points. In one non-limiting embodiment, if the player has to exceed 34 points, the player must call "Go". The opposing player(s) then continue to play until no player can play without the count exceeding 34 points. If a player fails to audibly count any points in the hand or crib, the opposing player can call "muggings," and score these points for himself Players, are thus penalized for failing to audibly count points. This card scoring combination is optional, much like counting the 4-card flush in the crib. Thus, in playing the Holtey 500 Cribbage card game, there is a change of the card play count limit, from 31 points, which is the traditional point limit at which "Go" is called, to the novel utilization of 34 points.

A final Step 326 includes winning the game by scoring the most points tallied from the first, second, and third scoring combinations. In the case of Holtey 500 Cribbage game, the required points to win is 500 points, which is a tally of points produced from the first, second, and third scoring combinations. If a player does not reach 500 points in the final tally, whatever difference in points remains between the point total and 500 are added to the opposing player's score as "penalty-honors." If neither player reaches 500 points there are no penalty-honors tallied for either player. The pegs at the end of each row mark the count when a score of 30 or 60 in the red and green rows is reached, or 120 points in the yellow row is reached. If marking the score in such a manner is required, the players continue the count by marking further scores from the beginning of the appropriate row.

Figure 4:
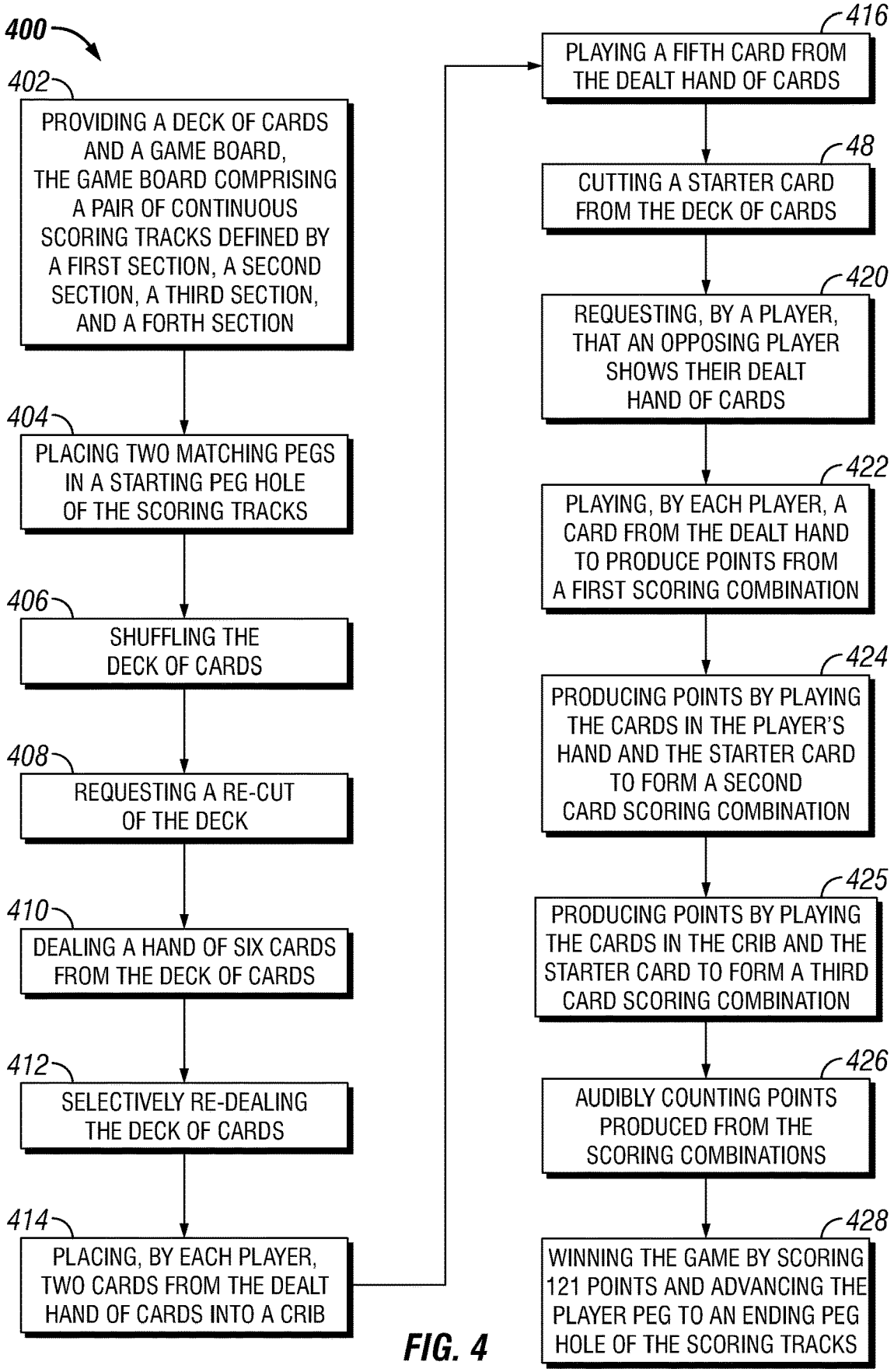
FIG. 4 illustrates a flowchart of an exemplary method of playing a Dealer's Cribbage card game with a universal Cribbage game board, in accordance with an embodiment of the present invention.

A second variation of the traditional Cribbage card game, shown in flowchart FIG. 4, is called "Dealer's Cribbage". The play of Dealer's Cribbage with the universal Cribbage game board is novel. The most significant variance from the traditional Cribbage game taught in a method 400 of playing Dealer's Cribbage card game, include:

1) After initial cards are dealt by the dealer, the non-dealer throws two cards to the Crib, and then flips the two Crib cards over to reveal them to the dealer.
2) Players can choose to re-deal a dealt hand of cards.
3) Players can choose to play with a fifth card from the dealt hand of cards (Pleading the Fifth).
4) Players can request a re-cut of the deck of cards.
5) Players can request to see the opposing player's hand of cards.

As referenced in flowchart of FIG. 4, the method 400 for playing the Dealer's Cribbage card game comprises an initial Step 402 of providing a deck of cards and a game board, the game board comprising a pair of continuous scoring tracks defined by a first section, a second section, and a third section, each section having a starting peg hole and an ending peg hole, each section having a unique indicium. In the Dealer's Cribbage configuration of the game, the game board 100 does not utilize the fourth section 110.

The method 400 may further comprise a Step 404 of placing two matching pegs in a starting peg hole of the scoring tracks. Players each use two pegs to record their points. When a player scores the first points of the game, one peg is placed in the first peg hole after the starting peg hole. And as the player scores subsequent points, the trailing peg hops over the leading peg so that the game board always shows how many points are recorded on the last score. Beginning from the starting peg hole. The only section of the scoring track that goes back down the inside is 124*c* for tracking hand scores.

In some embodiments, a Step 406 comprises shuffling the deck of cards. The dealer shuffles the entire deck and offers the cards to the other player(s) to cut. Both players cut the deck, and whoever draws the lowest card is the dealer. The deal alternates for each hand in the game thereafter.

A Step 408 includes requesting a re-cut of the deck of cards. In this feature, the consequence of receiving a poor hand is minimized. Each player can call for a re-cut twice per game. In some embodiments, the non-dealer chooses first whether to call a re-cut or not. If the non-dealer chooses not to re-cut then the dealer may call a re-cut if desired. Once either player calls a re-cut, the opposing player has the opportunity to counter re-cut, after which no further re-cuts can be called for that hand. Each player can re-cut twice in one deal if the opposing player does not counter the initial re-cut. In some embodiments, there are a maximum of 2 re-cuts per deal, whether they are both by one player, or one by each player. A re-cut is marked in a Re-cut peg hole 116*c* of the Privilege Section 116*a-d* of the game board 100.

A Step 410 includes dealing a hand of six cards from the deck of cards. The dealer deals six cards from the deck of cards 200, one at a time, to both players.

A Step 412 includes selectively re-dealing the deck of cards. The re-dealing is useful for satisfying players who are unhappy with their hand. The re-dealing rule is a unique privilege rule in Dealer's Cribbage, and includes one or both players calling a "Re-Deal" when the cards dealt are determined to be unsatisfactory to one or the other. A re-deal is marked in a Re-deal peg hole 116*a* of the privilege Section 116*a-d* of the game board 100.

Continuing with the method 400, a Step 414 comprises placing, by each player, two cards from the dealt hand of cards into a Crib. Each player picks up the six dealt cards and discards two cards into the Crib. The non-dealer throws his cards first, face up, revealing them to the dealer. Those four cards (two from each player) go into the Crib, forming a third hand of four cards that the dealer uses to produce points. Thus, the dealer aims to discard cards into the Crib that give a good chance of a high scoring hand; whereas the opposing player aims to confound this objective. The non-dealer places his Crib cards down first, face up, so the dealer can see them before throwing his own Crib cards face down.

In some embodiments, a Step 416 may include playing a fifth card from the dealt hand of cards. This is referred to as "Pleading the Fifth". Pleading the Fifth occurs when players desire playing five cards from their hand instead of four cards. This allows players to utilize the fifth card from their hand when scoring, instead of, or in addition to, the cut card. The Pleading the Fifth dealer advantage allows the player to take advantage of a favorable hand of cards. Thus, Pleading the Fifth is called by either or both players, before the deck is cut. Each player has two opportunities per game to Plead the Fifth. Thus, the player optimizes the utility of the cards a player is dealt, instead of sacrificing one usable card to the Crib. Pleading the Fifth is marked in a Pleading the Fifth peg hole 116*b* of the Privilege Section 116*a-d* of the game board 100.

As discussed above, when a player Pleads the Fifth, the player is allowed to utilize five cards from the dealt hand, instead of four cards. An additional card is used. Nonetheless, a player Pleading the Fifth still discards two cards into the Crib, but one of the cards is the player's "fifth card," which can be utilized for scoring in the hand and as a card in the Crib if the player is the dealer. Furthermore, if the dealer Pleads the Fifth, the player places the fifth card and the other chosen card to discard into the Crib facedown, as usual. But the player sets the fifth card noticeably off to the side in order to keep it identified. If the non-dealer Pleads the Fifth, the player reveals the fifth card and the other selected card to discard to the Crib, to the dealer, as usual. The player also sets the fifth card noticeably off to the side in order to keep it identified.

It is significant to note that the fifth card is not used in card play. Also, no points are scored for choosing a Jack card as the fifth card; and, no points are scored if the player holds the Jack card of the same suite as the fifth card either in the player's hand or the crib. If a player chooses a Jack as a fifth card, however, a point is scored if the suit of the jack matches the suit of the cut card. If the dealer chooses a Jack card as a fifth card that matches the suit of the cut card, 2 points are scored, 1 point for the dealer's hand and 1 point for the dealers Crib. If both players Plead the Fifth, then the absolutely necessary cut is still made, only for the purpose of the possible point the dealer may score if the cut card is a Jack card, and for the single point that either player may still score if holding the Jack of the same suit as the absolutely necessary cut.

A Step 418 comprises cutting a Starter card from the deck of cards. After both players decide which four cards to keep, the non-dealer player cuts the remaining cards of the stock, and the dealer turns over the top card of the cut deck to reveal the Starter card. The Starter card essentially becomes part of all three hands, the dealer's hand, the non-dealers hand, and the Crib. The Starter card does not, however, participate in the playing out of the hand.

The method 400 also include a Step 420 of requesting, by one player, that an opposing player shows the hand of cards. Each player, twice per game, can ask the opposing player to show the 4 cards in the hand. A player can only call "show" after the deck of cards has been cut. Furthermore, that player may not call a Re-Cut subsequent to calling a Show.

When a player calls "show," the opposing player must show the 4 cards in the hand. Once the player who calls "show" has seen the cards in the opposing player's hand, the player who has shown the cards conceals them, and card play ensues as usual. Further, in the case that the dealer has "Pleaded the Fifth" and the non-dealer calls "Show," the dealer shows only the 4 cards in the hand and not the fifth card. Requesting a "Showing" of the hand of cards is marked in a Show peg hole 116*d* of the Privilege Section 116*a-d* of the game board 100.

The method 400 may further comprise a Step 422 includes playing, by each player, a card from the dealt hand to form a first scoring combination. The scoring combination may generate points for the players, based on the type of scoring combination. The card that is played may also not be effective in scoring points if no scoring combination is possible. The players alternate playing their cards to create scoring combinations off each other. Thus, an alternative Step comprises alternatively playing, by the players, the dealt hand of cards. The players alternate playing a card and the Starter card to achieve a desired scoring combination.

In one card scoring combination, any time the card played brings the total of cards played to 15, 2 points are scored. Every combination of 15 in the player's hand and crib scores 2 points. For example: a 5 card and a face card having a value of ten. A 7 card and an 8 card. A combination of 3-2-10 cards, 4-5-6 cards, etc. In another card scoring combination, 2 points are scored when a card is played that is the same value (or same face-card rank) as the prior played card. Pairs also score 2 points in each hand or crib.

In another card scoring combination, 6 points are scored if the played card is the 3rd of its kind sequentially in card play. For example, a 3 of-a-kind also scores 6 points in each hand or crib. In yet another card scoring combination, 12 points are scored for a 4 of-a-kind during card play. In yet another card scoring combination, 3 points are scored for a "run", or sequential play, of 3 cards during card play. These cards do not need to be of the same suite, and may include, for example, Ace-2-3, or 10-Jack-Queen. To score a "run" in card play, the cards do not need to be played in exact order. For example, the play could be 10, Queen, Jack; and the player that plays the Jack scores 3 points. Similarly, a run of four cards scores 4 points. And a run of five cards scores 5 points.

In yet another card scoring combination, a hand such as 6, 7, 7, 8 is a double run of 3. The player scores one run of 3 using one 7 card, and another run of 3 using the other 7 card, for a total of 6 points. The player also scores an additional 2 points for the pair of 7 cards; and, in the case of this hand, scores 4 more points for the two combinations of 15 made with the 7 cards and the 8 card. This hand scores 12 points in total.

In yet another card scoring combination, 4 cards of the same suit played in sequence during card play score 4 points; a flush of 5 scores 5 points, and so on. To score a flush in the hand or crib, all 4 cards must be of the same suit; and if the cut card matches, 5 points are scored. Some players of cribbage choose not to count a 4-card flush in the crib, and only allow a flush in the crib when the cut card matches to make a 5-card flush for 5 points. In yet another card scoring combination, 2 points are scored for the player who is the dealer, if the cut card is a Jack card. In yet another card scoring combination, 1 point is scored, if the player has a Jack card in the hand or crib that is the same suit as the cut card.

A Step 424 comprises producing points by playing the cards in the player's hand and the Starter card to form a second card scoring combination. In this manner, the player cards and the Starter card are counted in multiple combinations to tally points.

A Step 425 comprises producing points by playing the cards in the Crib and the Starter card to form a third card scoring combination. In this manner, the Crib cards and the Starter card are counted in multiple combinations to tally points.

In some embodiments, a Step 426 comprises audibly counting points that are scored.

A subsequent Step includes audibly indicating if a player cannot play a card without causing the card count of all the played cards to exceed 31 points. In one non-limiting embodiment, if the player has to exceed 31 points, the player must call "Go". The opposing player(s) then continue to play until no player can play without the count exceeding 31 points. Once 31 is reached or no one is able to play, the player who played the last scored card scores 1 point if the count is under 31 or 2 points if the count is exactly 31. The count is then reset to zero, and play commenced. If a player fails to audibly count any points in the hand or crib, the opposing player can call "muggings," and score these points for himself Players, are thus penalized for failing to audibly count points. This card scoring combination is optional, much like counting the 4-card flush in the crib.

In some embodiments, a Step may include advancing, by each player, a peg into the scoring peg holes along the scoring tracks, in correspondence with the scored points. In some embodiments, advancing one scoring peg hole equates to one point scored, advancing two scoring peg holes equates to two points scored, etc. The players advance the pegs along the first, second, and third sections 104, 106, 108 of the scoring tracks 102*a-b*.

A final Step 428 includes winning the game by scoring 121 points and advancing the playing peg to an ending peg hole of the scoring tracks.

Figure 5:
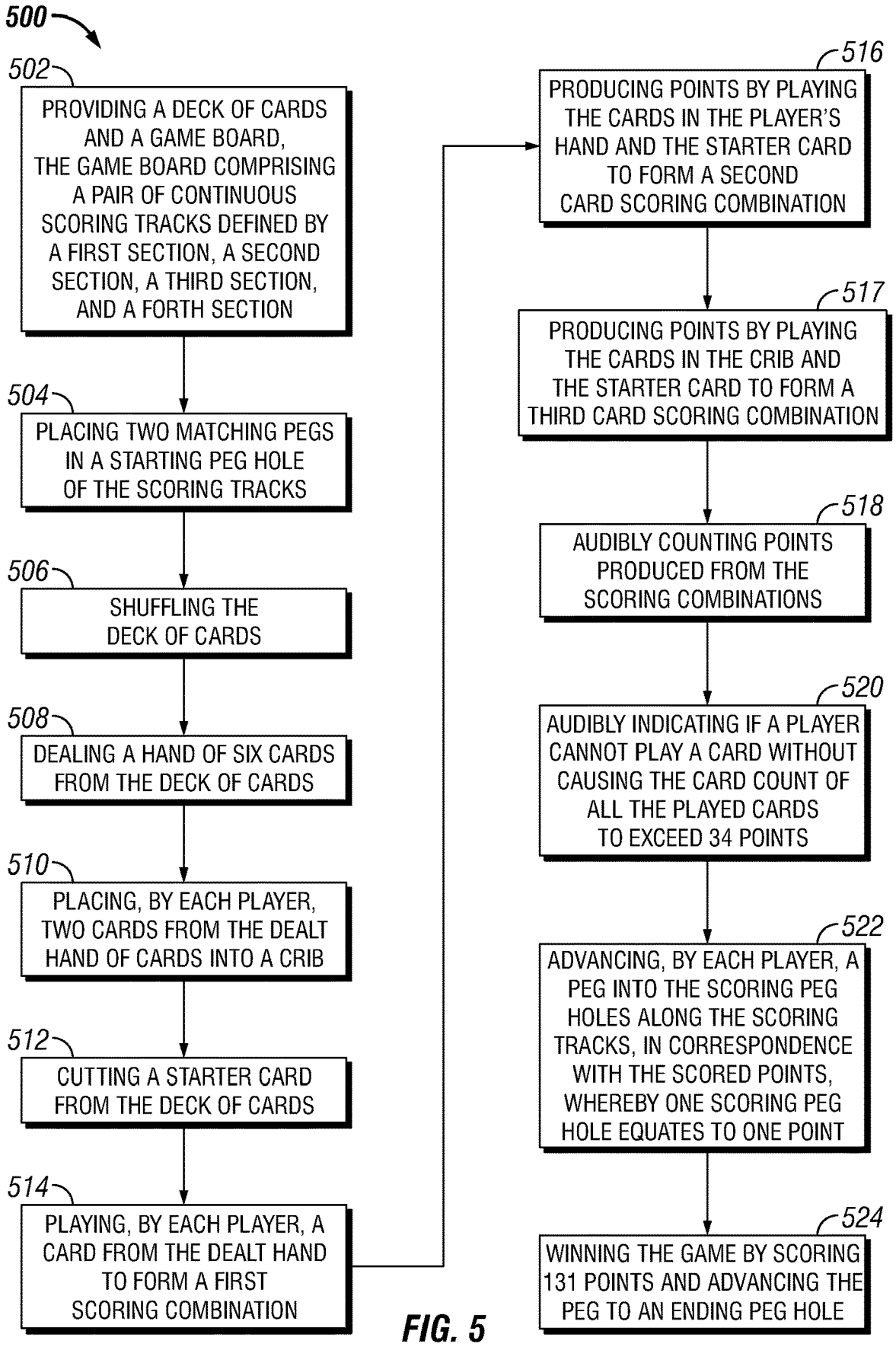
FIG. 5 illustrates a flowchart of an exemplary method of playing a Magic Cribbage card game with a universal Cribbage game board, in accordance with an embodiment of the present invention.

A third variation of the traditional Cribbage card game, shown in flowchart of FIG. 5, is called "Magic Cribbage". The play of Magic Cribbage is known in the art, and the use with the universal Cribbage game board is novel.

The most significant variance from the traditional Cribbage game taught in a method 500 of playing Magic Cribbage card game, include:

1) Playing rules based on the principles of "Magic Squares".
2) The fourth section, and 10 extra peg holes/points (purple color) of the scoring tracks is utilized.
3) The primary scoring mechanism is the "15 Combination".
4) The card play count limit is 34. Players play cards and score points that reach a running total of 34 points before losing their turn. The traditional Cribbage game only allowed the point tally to reach 31 points before the player lost their turn.
5) The winning score is 131.
6) The unique rules of Magic Cribbage can be applied to a traditional Cribbage, a Holtey 500 Cribbage game, and a Dealer's Cribbage game.

Those skilled in the art will recognize that magic squares, in general, are squares that when divided into smaller squares create vertical, horizontal and diagonal sums of an equal sum. The magical sum of the 3×3 square is 15, and the sum of the 4×4 square is 34. The sum of the 5×5 magic square is 65, which can easily be incorporated into cribbage play when you understand the history of the game. It is also known in the art that the pre-cursor to modern cribbage is the game "Noddy," which is played with virtually the same rules as cribbage except the winner only has to reach a total of 61 points instead of 121. The Noddy board only has 60 peg holes and the winner is the first to go once around the board. The change to 121 points, or twice around the board, is a comparatively modern innovation in cribbage. Thus, the Magic Cribbage game is played upon the principles of the magic squares. The Magic Cribbage game, however, modifies the original winning total of Noddy to 65 (the sum of the 5×5 square), and doubles that total to 130 for modern cribbage play. Thus, in Magic Cribbage, the winner is the first to "peg out" with a total of 131 points.

As referenced in flowchart of FIG. 5, the method 500 for playing the Magic Cribbage card game may include an initial Step 502 of providing a deck of cards and a game board, the game board comprising a pair of continuous scoring tracks defined by a first section, a second section, a third section, and a fourth section, each section having a starting peg hole and an ending peg hole, each section having a unique indicium. In one embodiment, the first section is green. The second section is red. The third section is yellow. And the fourth section is purple. In this Magic Cribbage configuration of the game, the game board 100 utilizes the fourth section, adding two extra rows of 10 peg holes (one for each player), plus an ending peg hole. This serves to create the necessary structure for counting a total of 131 points along a continuous scoring track. In one non-limiting embodiment, the extra row of 10 peg holes in the fourth section is conveniently distinguished with a purple color.

A Step 504 includes placing two matching pegs in a starting peg hole of the scoring tracks. Players each use two pegs to record their points. When a player scores the first points of the game, one peg is placed in the first peg hole after the starting peg hole. And as the player scores subsequent points, the trailing peg hops over the leading peg so that the game board always shows how many points are recorded on the last score. Beginning from the starting peg hole, the pegs move up the outside part of the scoring track and then back down the inside the scoring track.

In some embodiments, a Step 506 comprises shuffling the deck of cards. The dealer shuffles the entire deck and offers the cards to the other player(s) to cut. Both players cut the deck, and whoever draws the lowest card is the dealer. The deal alternates for each hand in the game thereafter.

A Step 508 includes dealing a hand of six cards from the deck of cards. The dealer deals six cards from the deck of cards 200, one at a time, to both players.

In some embodiments, a Step 510 may include placing, by each player, two cards from the dealt hand of cards into a Crib. Each player picks up the six dealt cards and discards two cards face-down from the six cards. Those four cards (two from each player) go into the Crib, forming a third hand of four cards that the dealer uses to produce points. Thus, the dealer aims to discard cards into the Crib that give a good chance of a high scoring hand; whereas the opposing player aims to confound this objective.

A Step 512 comprises cutting a Starter card from the deck of cards. After both players decide which four cards to keep, the non-dealer player cuts the remaining cards of the stock, and the dealer turns over the top card of the cut deck to reveal the Starter card. The Starter card essentially become part of all three hands, the dealer's hand, the non-dealers hand, and the Crib. The Starter card does not take part in the playing out of the hand though.

The method 500 may further comprise a Step 514 includes playing, by each player, a card from the dealt hand to form a first scoring combination. The scoring combination may generate points for the players, based on the type of scoring combination. The card that is played may also not be effective in scoring points if no scoring combination is possible. The players alternate playing their cards to create scoring combinations off each other. Thus, an alternative Step comprises alternatively playing, by the players, the dealt hand of cards. The players alternate playing a card to achieve a desired scoring combination.

In one first scoring combination, any time the card played brings the total of cards played to 15, 2 points are scored. Every combination of 15 in the player's hand and crib scores 2 points. For example: a 5 card and a face card having a value of ten. A 7 card and an 8 card. A combination of 3-2-10 cards, 4-5-6 cards, etc. In another card scoring combination, 2 points are scored when a card is played that is the same value (or same face-card rank) as the prior played card. Pairs also score 2 points in each hand or crib.

In another first scoring combination, 6 points are scored if the played card is the 3rd of its kind sequentially in card play. For example, a 3 of-a-kind also scores 6 points in each hand or crib. In yet another card scoring combination, 12 points are scored for a 4 of-a-kind during card play. In yet another card scoring combination, 3 points are scored for a "run", or sequential play, of 3 cards during card play. These cards do not need to be of the same suite, and may include, for example, Ace-2-3, or 10-Jack-Queen. To score a "run" in card play, the cards do not need to be played in exact order. For example, the play could be 10, Queen, Jack; and the player that plays the Jack scores 3 points. Similarly, a run of four cards scores 4 points. And a run of five cards scores 5 points.

In yet another first scoring combination, a hand such as 6, 7, 7, 8 is a double run of 3. The player scores one run of 3 using one 7 card, and another run of 3 using the other 7 card, for a total of 6 points. The player also scores an additional 2 points for the pair of 7 cards; and, in the case of this hand, scores 4 more points for the two combinations of 15 made with the 7 cards and the 8 card. This hand scores 12 points in total.

In yet another first scoring combination, 4 cards of the same suit played in sequence during card play score 4 points; a flush of 5 scores 5 points, and so on. To score a flush in the hand or crib, all 4 cards must be of the same suit; and if the cut card matches, 5 points are scored. Some players of cribbage choose not to count a 4-card flush in the crib, and only allow a flush in the crib when the cut card matches to make a 5-card flush for 5 points. In yet another card scoring combination, 2 points are scored for the player who is the dealer, if the cut card is a Jack card. In yet another card scoring combination, 1 point is scored, if the player has a Jack card in the hand or crib that is the same suit as the cut card.

In yet another first scoring combination, if a player cannot play without causing the card count to exceed 34, the player audibly calls "Go". The other player continues to play until no one can play without the count exceeding 34. Once 34 is reached or no one is able to play, the player who played the last scored card scores 1 point if the count is under 34 or 2 points if the count is exactly 34. The count is then reset to zero, and play commenced. In yet another card scoring combination, if a player fails to audibly count any points in the hand or crib, the opposing player can call "muggings," and score these points for himself. This card scoring combination is optional, much like counting the 4-card flush in the crib.

The method 500 may further comprise a Step 516 of producing points by playing the cards in the player's hand and the Starter card to form a second scoring combination. The player cards and the Starter card are counted in multiple combinations, so as to tally points.

The method 500 may further comprise a Step 517 of producing points by playing the cards in the Crib and the Starter card to form a second scoring combination. The Starter card and the Crib cards are counted in multiple combinations, so as to tally points.

In some embodiments, a Step 518 comprises audibly counting points that are scored.

A subsequent Step 520 includes audibly indicating if a player cannot play a card without causing the card count of all the played cards to exceed 34 points. In one non-limiting embodiment, if the player has to exceed 34 points, the player must call "Go". The opposing player(s) then continue to play until no player can play without the count exceeding 34 points. If a player fails to audibly count any points in the hand or crib, the opposing player can call "muggings," and score these points for himself Players, are thus penalized for failing to audibly count points.

A Step 522 comprises advancing, by each player, a peg into the scoring peg holes along the scoring tracks, in correspondence with the scored points, whereby one scoring peg hole equates to one point.

A final Step 524 includes winning the game by scoring 131 points and advancing the peg to an ending peg hole.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

In alternative embodiments, the universal Cribbage game board 100 is digitized and the method 300, 400, 500 is played through a digitized network. For example, the game board is viewable on a computer display. Multiple players can compete remotely form each other through a processor, a server, and an Internet connection. The cards are randomly shuffled and dealt according to the rules of each variation of the Cribbage game. The points are automatically computed by the processor, and displayed on the computer display.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A universal Cribbage game board for playing multiple versions of a Cribbage game, the game board comprising: a deck of cards comprising fifty-two cards, the deck of cards being operable to be played for producing points during play of multiple versions of a Cribbage game; a flat panel defined by a central panel and a pair of continuous scoring tracks separated by the central panel, the scoring tracks being symmetrically positioned on either side of the central panel, the scoring tracks comprising at least 130 scoring peg holes representing a total of at least 130 points in the variations of the Cribbage card game, the scoring tracks having a first section defined by a first color, a second section defined by a second color, a third section defined by a third color, and a fourth section defined by a fourth color, whereby the first, second, and third sections of the scoring tracks are operable with a first version of the Cribbage card game and a second version of the Cribbage card game, whereby the first, second, third, and fourth sections of the scoring tracks are operable with a third version of the Cribbage card game, multiple starting peg holes disposed at a termini of the respective sections of the scoring tracks, multiple ending peg holes disposed at the opposing termini of the respective sections of the scoring tracks, a Privilege Section operable to mark multiple functions of the Cribbage game; and multiple playing pegs operable to advance along the scoring tracks from the starting peg holes to the ending peg holes for marking points produced during card play, the playing pegs being defined by distinguishing indicia.

2. The game board of claim 1, wherein the Privilege Section comprises multiple Re-deal peg holes, multiple Plead the Fifth peg holes, multiple Re-cut peg holes, and multiple Show peg holes.

3. The game board of claim 2, wherein the Privilege Section comprises the Re-deal peg holes for marking the function of re-dealing of the deck of cards, the Plead the Fifth peg holes for marking the function of a fifth card being played from a dealt hand of cards, the Re-cut peg holes for marking the function of re-cutting of the deck of cards, and the Show peg holes for marking the function of a request to view a dealt hand from the deck of cards.

4. The game board of claim 1, wherein the Privilege Section is arranged in eight spaced-apart rows.

5. The game board of claim 1, wherein first color of the first section is green, the second color of the second section is red, the third color of the third section is yellow, and the fourth color of the fourth section is purple.

6. A universal Cribbage game board for playing multiple versions of a Cribbage game, the game board comprising: a deck of cards comprising fifty-two cards; a flat panel defined by a central panel and a pair of continuous scoring tracks separated by the central panel, the scoring tracks being symmetrically positioned on either side of the central panel, the scoring tracks comprising at least 130 scoring peg holes representing a total of at least 130 points in the variations of the Cribbage card game, the scoring tracks having a first section defined by a first color, a second section defined by a second color, a third section defined by a third color, and a fourth section defined by a fourth color, multiple starting peg holes disposed at a termini of the respective sections of the Response to Office Action Examiner: Michael David Dennis scoring tracks, multiple ending peg holes disposed at the opposing termini of the respective sections of the scoring tracks, a Privilege Section operable to mark multiple functions of the Cribbage game; and multiple playing pegs operable to advance along the scoring tracks from the starting peg holes to the ending peg holes for marking points produced during card play, the playing pegs being defined by distinguishing indicia.

7. The game board of claim 6, wherein the Privilege Section comprises multiple Re-deal peg holes, multiple Plead the Fifth peg holes, multiple Re-cut peg holes, and multiple Show peg holes.

8. The game board of claim 7, wherein the Privilege Section comprises the Re-deal peg holes for marking the function of re-dealing of the deck of cards, the Plead the Fifth peg holes for marking the function of a fifth card being played from a dealt hand of cards, the Re-cut peg holes for marking the function of re-cutting of the deck of cards, and the Show peg holes for marking the function of a request to view a dealt hand from the deck of cards.

9. The game board of claim 6, wherein the Privilege Section is arranged in eight spaced-apart rows.

10. The game board of claim 6, wherein first color of the first section is green, the second color of the second section is red, the third color of the third section is yellow, and the fourth color of the fourth section is purple.

* * * * *